US010487586B2

(12) United States Patent
Roberts

(10) Patent No.: US 10,487,586 B2
(45) Date of Patent: Nov. 26, 2019

(54) STEERABLE MOLE BORING SYSTEM

(71) Applicant: Kelley Roberts, New Britain, CT (US)

(72) Inventor: Kelley Roberts, New Britain, CT (US)

( * ) Notice: Subject to any disclaimer, the term of this patent is extended or adjusted under 35 U.S.C. 154(b) by 226 days.

(21) Appl. No.: 15/624,358

(22) Filed: Jun. 15, 2017

(65) Prior Publication Data

US 2018/0363379 A1 Dec. 20, 2018

(51) Int. Cl.

| | |
|---|---|
| ***E21B 7/06*** | (2006.01) |
| ***E21B 1/00*** | (2006.01) |
| ***E21B 47/00*** | (2012.01) |
| ***E21B 7/26*** | (2006.01) |
| ***E21B 47/09*** | (2012.01) |

(52) U.S. Cl.

CPC ..... *E21B 7/067* (2013.01); *E21B 1/00* (2013.01); *E21B 7/26* (2013.01); *E21B 47/00* (2013.01); *E21B 47/0002* (2013.01); *E21B 47/09* (2013.01)

(58) Field of Classification Search

CPC ..... E21B 47/0002; E21B 7/067; F16C 11/06; F16H 1/02

See application file for complete search history.

(56) References Cited

U.S. PATENT DOCUMENTS

| | | | | |
|---|---|---|---|---|
| 2,932,243 A | | 4/1960 | Woronoff | |
| 4,632,191 A | * | 12/1986 | McDonald | E21B 4/145 173/91 |
| 4,646,277 A | * | 2/1987 | Bridges | E21B 4/145 166/65.1 |
| 5,078,218 A | * | 1/1992 | Smet | E21B 4/02 175/107 |
| 5,101,912 A | * | 4/1992 | Smet | E21B 7/068 175/26 |
| 5,519,543 A | | 5/1996 | Olsson et al. | |
| 5,652,617 A | | 7/1997 | Barbour | |
| 5,711,381 A | * | 1/1998 | Archannbeault | G01V 3/08 175/45 |
| D490,872 S | | 6/2004 | Langner | |
| 7,555,970 B2 | * | 7/2009 | Hawkes | F16H 55/24 74/665 A |
| 8,235,142 B2 | | 8/2012 | Carlson et al. | |
| 8,250,936 B1 | | 8/2012 | Sawyer | |
| 8,997,890 B2 | | 4/2015 | Mercer | |

(Continued)

FOREIGN PATENT DOCUMENTS

| | | | | |
|---|---|---|---|---|
| WO | WO-9108353 A1 * | 6/1991 | | E21B 7/068 |
| WO | WO2013012981 | 1/2013 | | |

OTHER PUBLICATIONS

American Heritage® Dictionary of the English Language, Fifth Edition. S.v. "strap." Retrieved Mar. 8 2019 from https://www.thefreedictionary.com/strap (Year: 2019).*

*Primary Examiner* — Robert E Fuller
*Assistant Examiner* — Theodore N Yao

(57) ABSTRACT

A directional boring system includes a hammerhead mole that is fluidly coupled to a power source. The hammerhead mole selectively bores underground in a selected direction. A steering unit is movably coupled to the hammerhead mole and the steering unit frictionally engages the ground at a selected angle. In this way the hammerhead mole is steered in the selected angle. A remote control is provided and the remote control is in wireless electrical communication with the steering unit. In this way the remote control controls movement of the hammerhead mole.

16 Claims, 6 Drawing Sheets

(56) References Cited

U.S. PATENT DOCUMENTS

| | | | | |
|---|---|---|---|---|
| 9,115,542 | B1 * | 8/2015 | Calvert | E21B 7/205 |
| 2001/0052426 | A1 * | 12/2001 | Mercer | E21B 7/046<br>175/26 |
| 2004/0226747 | A1 * | 11/2004 | Stegmaier | E21B 7/06<br>175/19 |
| 2012/0073890 | A1 * | 3/2012 | Bindl | E02F 3/764<br>180/69.6 |
| 2014/0152802 | A1 * | 6/2014 | Olsson | A61B 1/05<br>348/84 |
| 2014/0192180 | A1 | 7/2014 | Sooy et al. | |
| 2014/0204197 | A1 * | 7/2014 | Olsson | G03B 37/005<br>348/84 |

* cited by examiner

STEERABLE MOLE BORING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to boring devices and more particularly pertains to a new boring device for steering a hammerhead mole underground.

BRIEF SUMMARY OF THE INVENTION

An embodiment of the disclosure meets the needs presented above by generally comprising a hammerhead mole that is fluidly coupled to a power source. The hammerhead mole selectively bores underground in a selected direction. A steering unit is movably coupled to the hammerhead mole and the steering unit frictionally engages the ground at a selected angle. In this way the hammerhead mole is steered in the selected angle. A remote control is provided and the remote control is in wireless electrical communication with the steering unit. In this way the remote control controls movement of the hammerhead mole.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
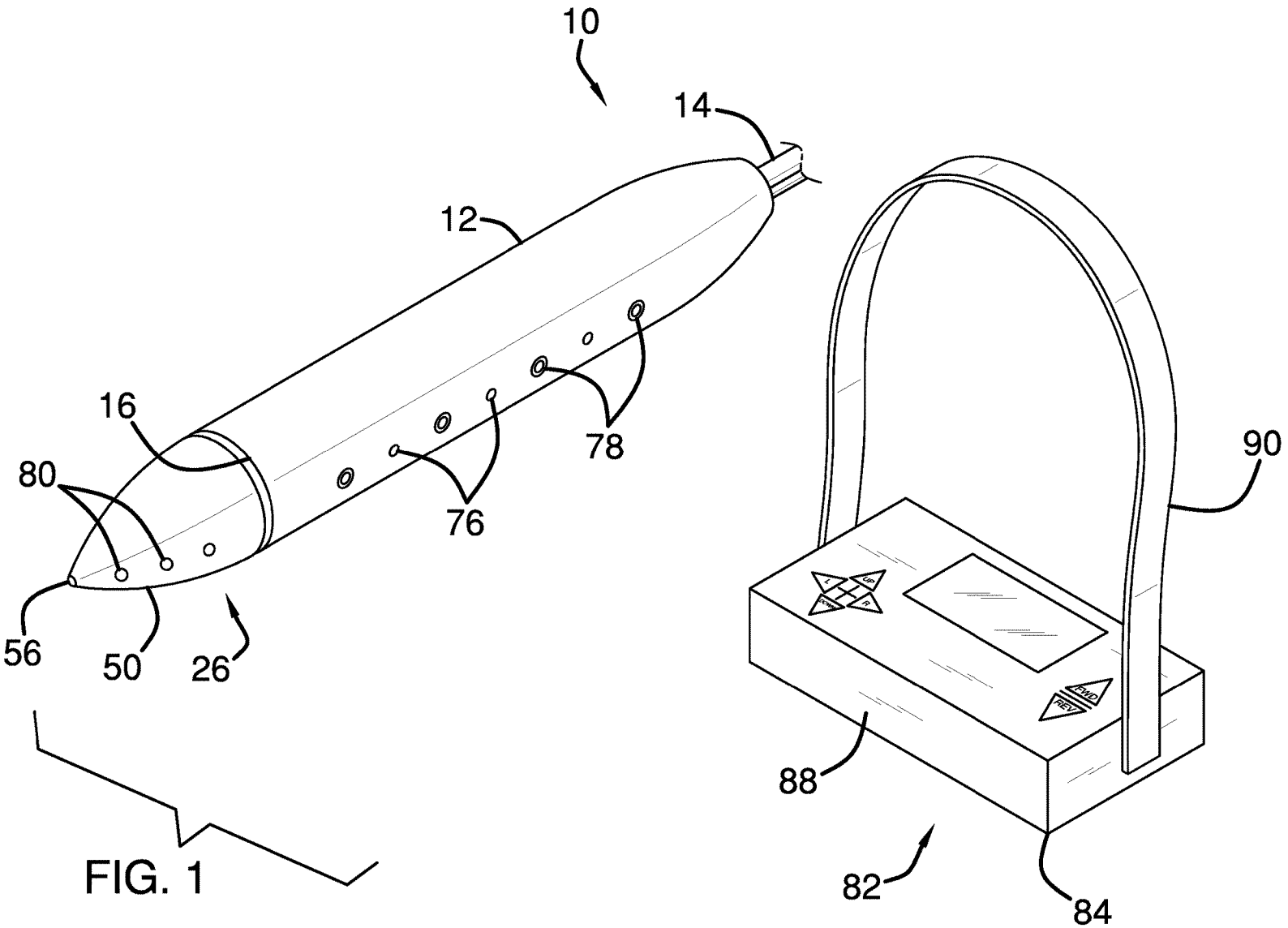
FIG. 1 is a perspective view of a directional boring system according to an embodiment of the disclosure.
Figure 2:
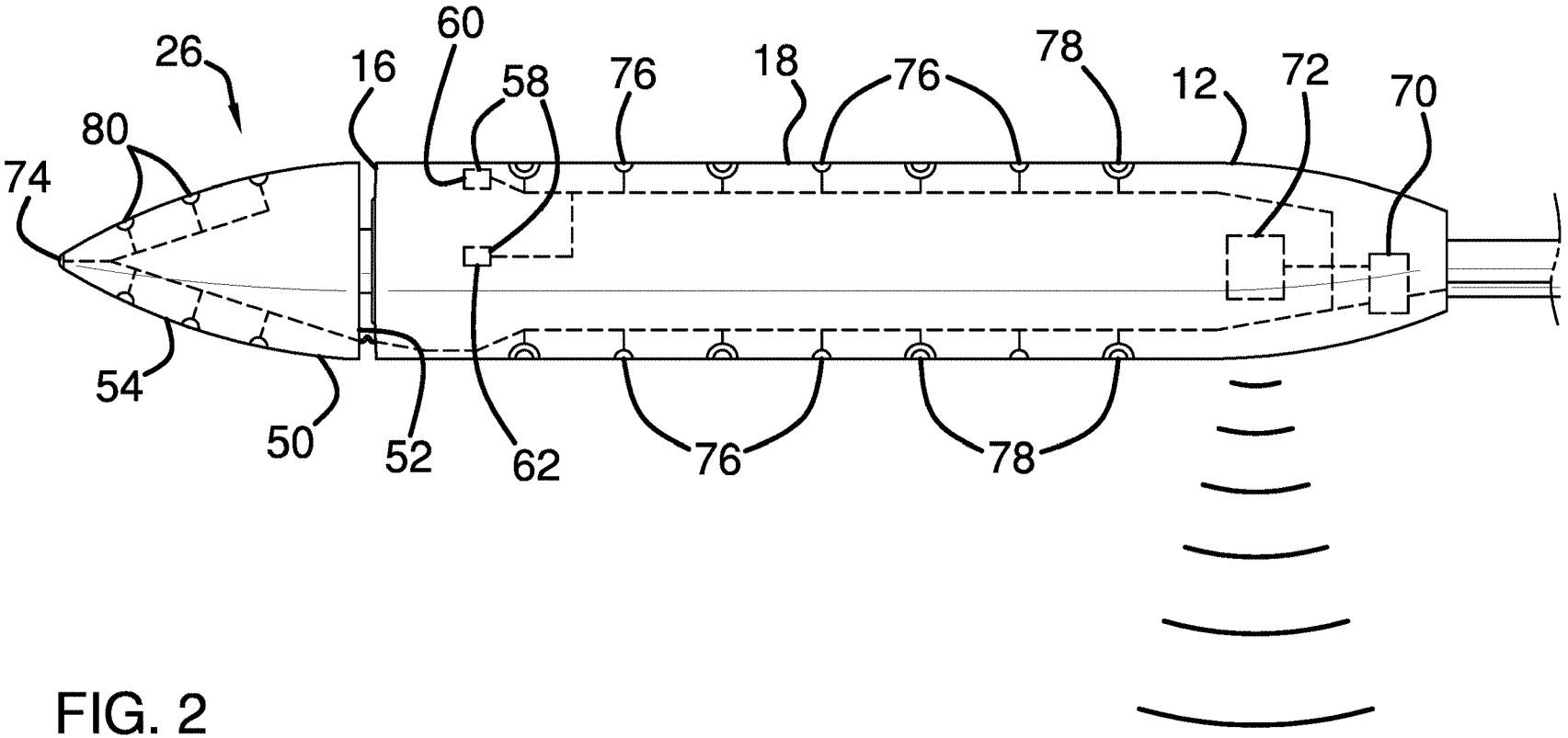
FIG. 2 is a top phantom view of an embodiment of the disclosure.
Figure 3:
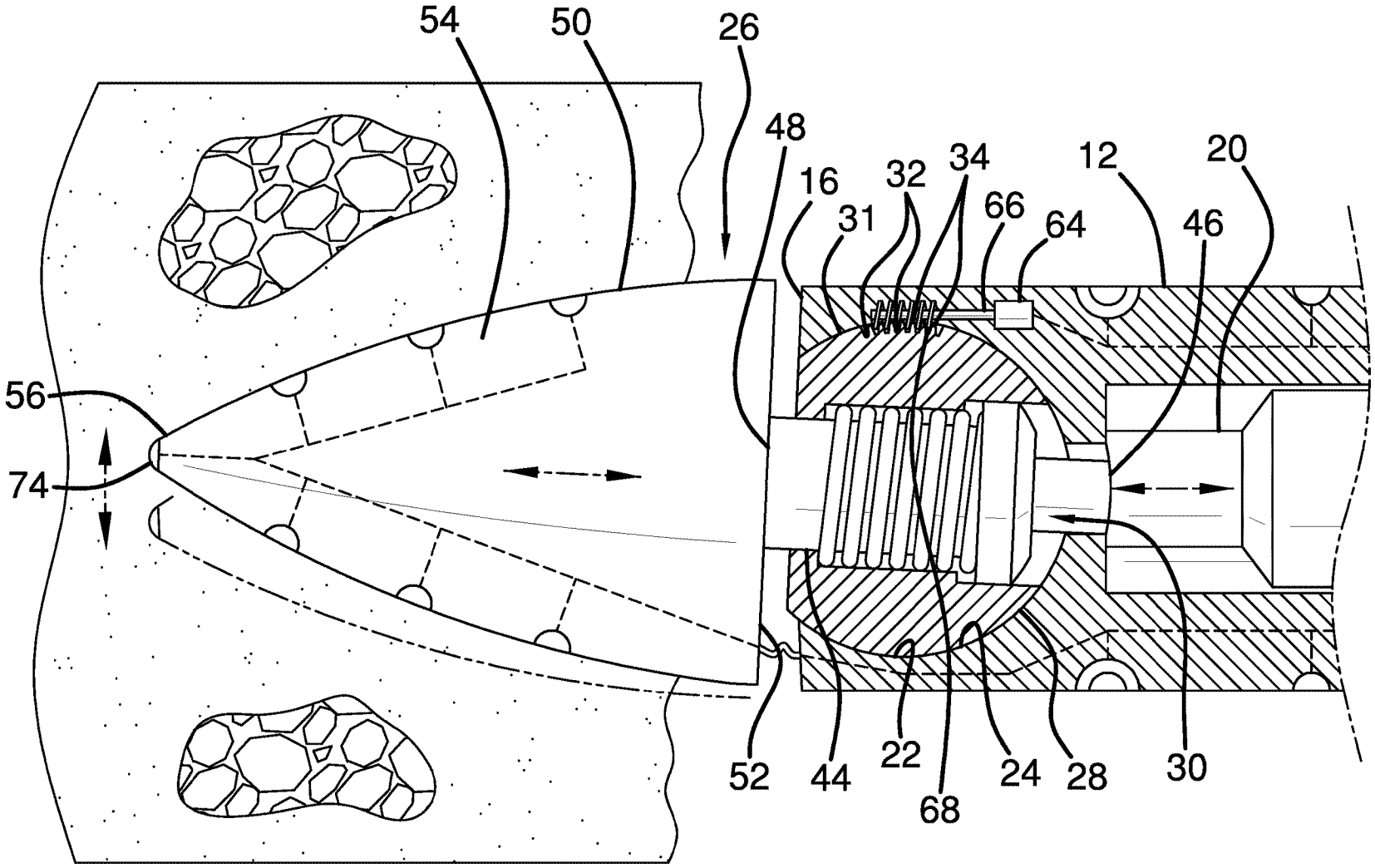
FIG. 3 is a top cut-away view of an embodiment of the disclosure.
Figure 4:
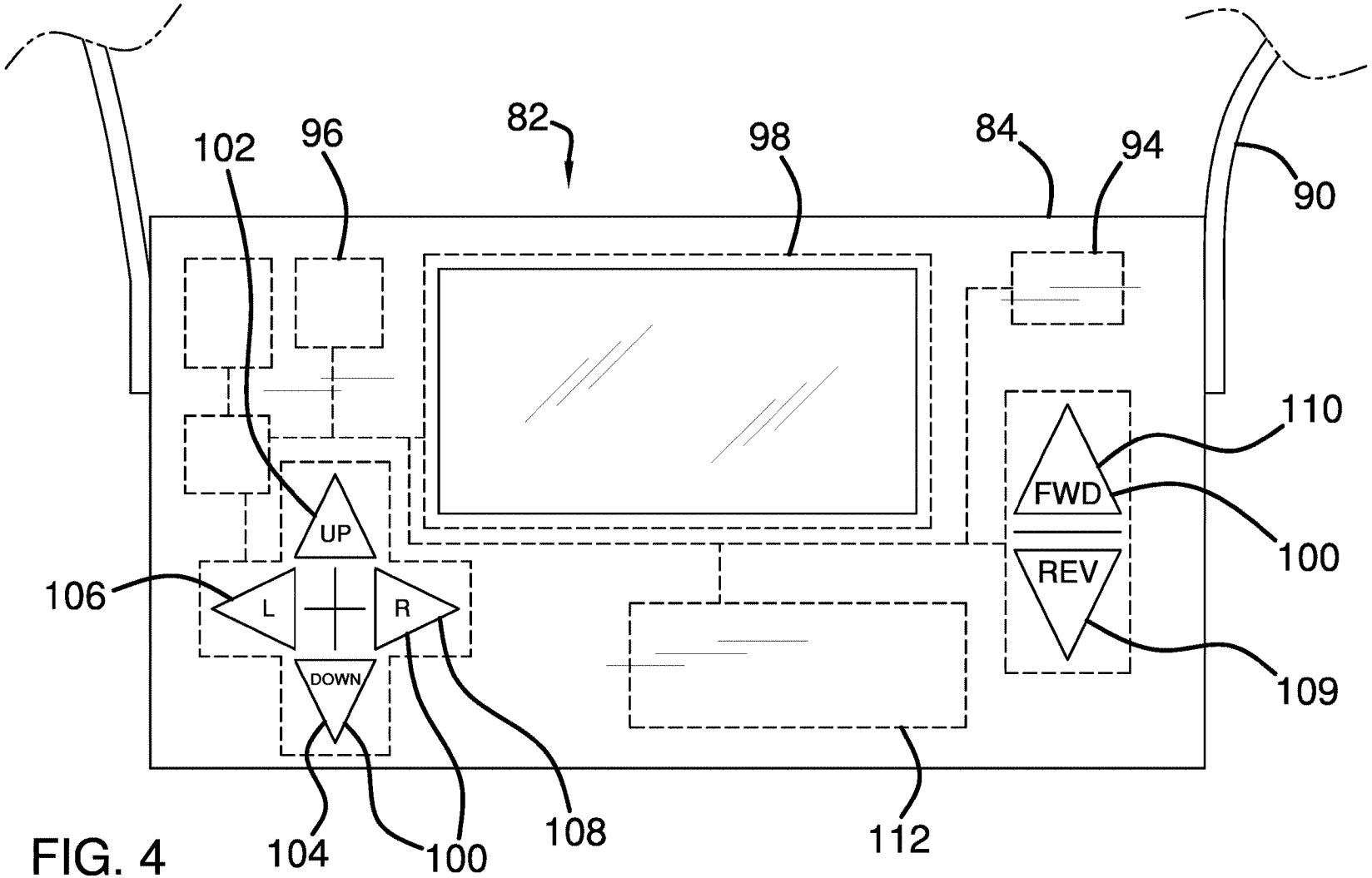
FIG. 4 is a top phantom view of a remote control of an embodiment of the disclosure.
Figure 5:
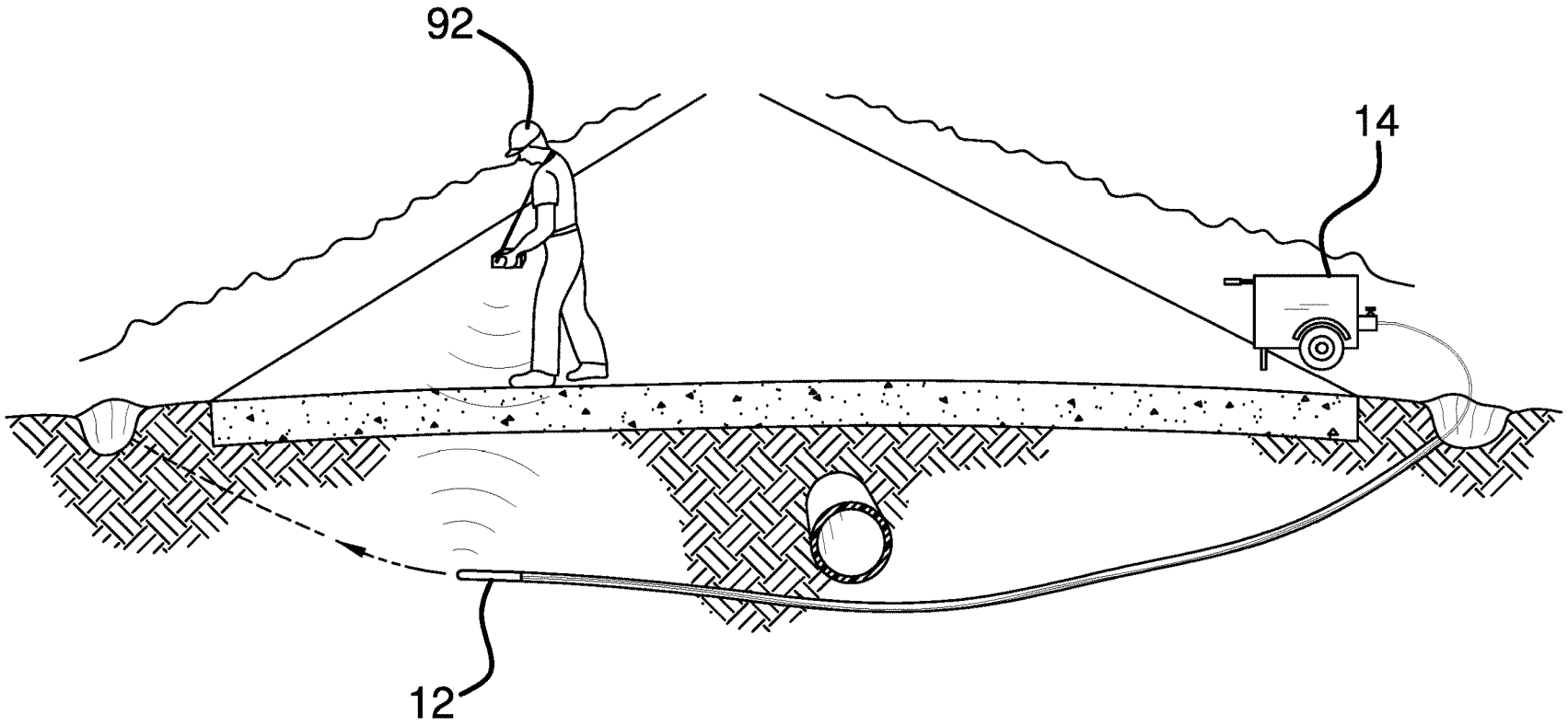
FIG. 5 is a perspective in-use view of an embodiment of the disclosure.
Figure 6:
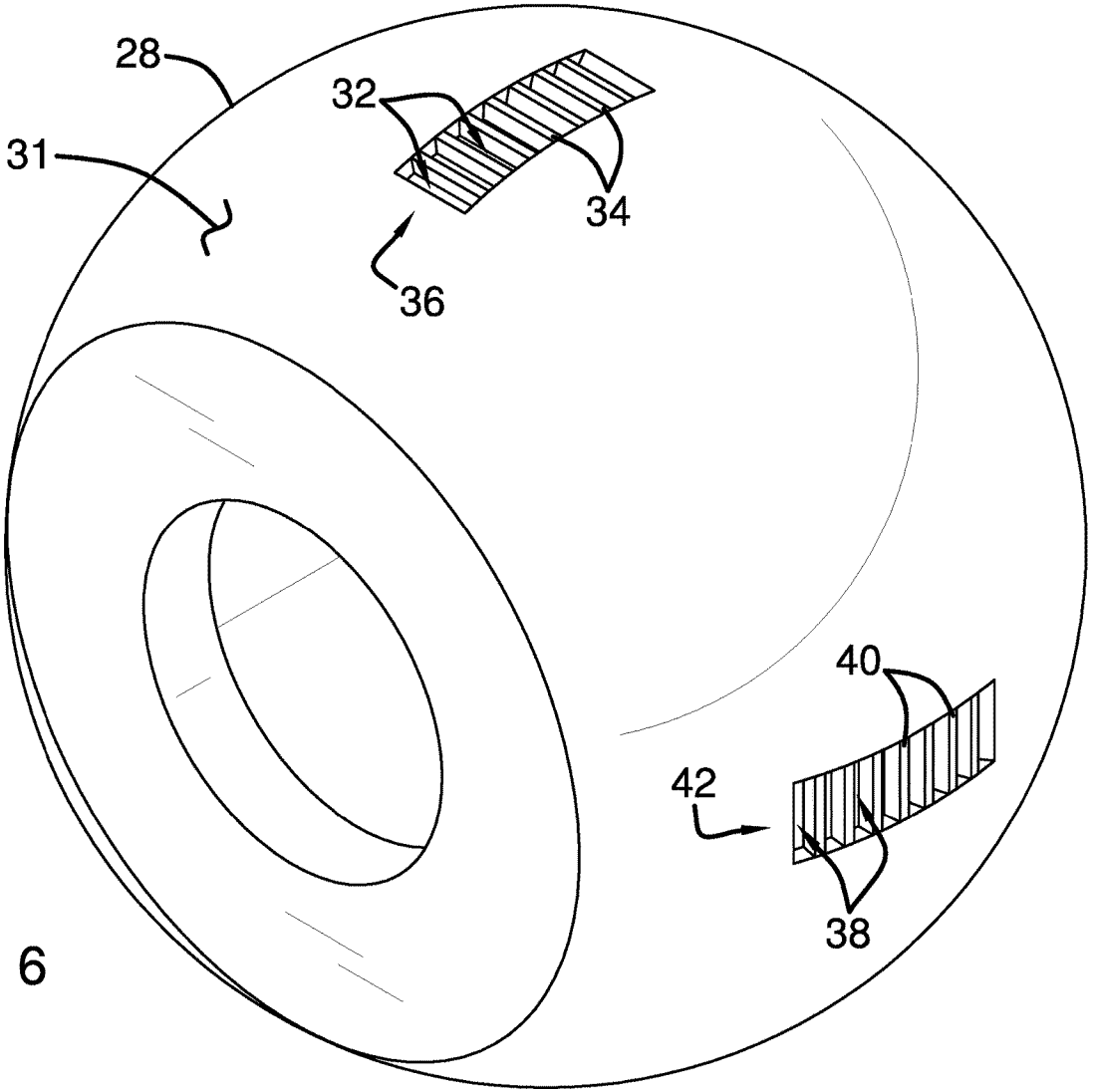
FIG. 6 is a perspective view of a ball of an embodiment of the disclosure.

With reference now to the drawings, and in particular to FIGS. 1 through 6 thereof, a new boring device embodying the principles and concepts of an embodiment of the disclosure and generally designated by the reference numeral 10 will be described.

As best illustrated in FIGS. 1 through 6, the directional boring system 10 generally comprises a hammerhead mole 12 that is fluidly coupled to a power source 14. The power source 14 may be a mobile air compressor or the like. Additionally, the hammerhead mole 12 may be a pneumatic piercing tool that is employed to bore underground in a selected direction. The hammerhead mole 12 has a first end 16, an outer surface 18 and a hammer 20. The first end 16 has a well 22 extending inwardly therein and the hammer 20 extends into the well 22. Moreover, the well 22 has a bounding surface 24 and the bounding surface 24 is continuous such that the well 22 forms a hemisphere.

A steering unit 26 is provided and the steering unit 26 is movably coupled to the hammerhead mole 12. The steering unit 26 frictionally engages the ground at a selected angle thereby facilitating the hammerhead mole 12 to move in the selected angle. Additionally, the steering unit 26 is in mechanical communication with the hammer 20. In this way the hammer 20 urges the steering unit 26 in the selected angle.

The steering unit 26 comprises a ball 28 that is rotatably positioned within the well 22. The ball 28 has an aperture 30 extending therethrough and an outer surface 31. The outer surface 31 has a plurality of first depressions 32 to define a plurality of first teeth 34. The first teeth 34 are spaced apart from each other and are distributed around the ball 28. Moreover, the first teeth 34 are arranged to form a first row 36.

The outer surface 31 has a plurality of second depressions 38 to define a plurality of second teeth 40. The second teeth 40 are spaced apart from each other and are distributed around the ball 28. Additionally, the second teeth 40 are arranged to form a second row 42. The first row 36 is spaced 90.0 degrees of rotation about the ball 28 from the second row 42. Each of the first 36 and second 42 rows extends substantially between opposite ends of the aperture 30.

A striking rod 44 is provided that has a first end 46 and a second end 48. The striking rod 44 extends through the aperture 30 has the first end 46 engaging the hammer 20. Additionally, the second end 48 is spaced from the first end 16 of the hammerhead mole 12. A head 50 is provided that has a primary wall 52 and a perimeter wall 54 extending away therefrom. The perimeter wall 54 is continuous around the primary wall 52 and the perimeter wall 54 tapers to a point 56 from the primary wall 52. Thus, the head 50 has a bullet shape to pierce the ground and the primary wall 52 is coupled to the second end of the striking rod 44.

A plurality of actuators 58 is provided and each of the actuators 58 is coupled to the hammerhead mole 12. Each of actuators 58 is in mechanical communication with the ball 28 and each of actuators 58 selectively rotates the ball 28 in a selected direction for steering. The plurality of actuators 58 includes a vertical actuator 60 and a horizontal actuator 62. In this way the head 50 is selectively angled upwardly, downwardly, to the left and to the right of the hammerhead mole 12.

Each of the actuators 58 comprises a motor 64 that is positioned within the hammerhead mole 12. The motor 64 selectively rotates in a first direction and a second direction. The motor 64 of the vertical actuator 60 is aligned with the first row 36 of teeth on the ball 28. The motor 64 of the horizontal actuator 62 is aligned with the second row 42 of teeth. Additionally, the motor 64 corresponding to each of the actuators 58 may be an electric motor 64 or the like.

A shaft 66 is coupled to the motor 64 and the motor 64 rotates the shaft 66 when the motor 64 is turned on. A worm gear 68 is coupled to the shaft 66 such that the shaft 66 rotates the worm gear 68 when the motor 64 is turned on. The worm gear 68 of the vertical actuator 60 engages the first row 36 of teeth. Moreover, the worm gear 68 of the vertical actuator 60 urges the ball 28 to rotate in a first and second direction about a horizontal axis extending through the hammerhead mole 12. In this way the head 50 engages the ground at a selected vertical angle thereby facilitating the hammerhead mole 12 to be selectively directed upwardly and downwardly in the ground.

The worm gear 68 of the horizontal actuator 62 engages the second row 42 of teeth. Additionally, the worm gear 68 of the horizontal actuator 62 urges the ball 28 to rotate in a third and fourth direction about a vertical axis extending through the hammerhead mole 12. In this way the head 50 engages the ground at a selected horizontal angle thereby facilitating the hammerhead mole 12 to be selectively directed to the left and to the right in the ground.

A first processor 70 is positioned within the hammerhead mole 12. The first processor 70 is electrically coupled to the vertical actuator 60, the horizontal actuator 62 and the power source 14. The first processor 70 may be an electronic processor or the like. A first transceiver 72 is positioned within the hammerhead mole 12 and the first transceiver 72 is electrically coupled to the first processor 70. The first transceiver 72 is in electrical communication with a global positioning system (gps) thereby facilitating the first processor 70 to establish a physical location of the hammerhead mole 12. The first transceiver 72 may be a radio frequency transceiver or the like and the first transceiver 72 may employ a WPAN signal.

A camera 74 is coupled to the point 56 on the head 50 to capture images of the ground in front of the head 50. The camera 74 is electrically coupled to the first processor 70 and the camera 74 may be a digital video camera or the like. A plurality of first light emitters 76 is provided and each of the first light emitters 76 is coupled to the outer surface 18 of the hammerhead mole 12 to emit light outwardly therefrom. Each of the first light emitters 76 is electrically coupled to the first processor 70 and each of the first light emitters may comprise an LED or the like.

A plurality of metal detectors 78 is provided and each of the metal detectors 78 is coupled to the outer surface 18 of the hammerhead mole 12 to detect metal in the ground. Each of the metal detectors 78 is electrically coupled to the first processor 70. Moreover, each of the metal detectors 78 may be an electronic metal detector or the like. A plurality of second light emitters 80 is provided and each of the second light emitters 80 is coupled to the perimeter wall 54 of the head 50 to emit light outwardly therefrom. Each of the second light emitters 80 is electrically coupled to the first processor 70 and each of the second light emitters 80 may comprise an LED or the like.

A remote control 82 is provided and the remote control 82 is in wireless electrical communication with the steering unit 26 such that the remote control 82 controls movement of the hammerhead mole 12. The remote control 82 comprises a housing 84 that has an outer wall 88 and a strap 90 that is coupled to the housing 84. The strap 90 is worn by a user 92 thereby facilitating the housing 84 to be retained on the user 92. Additionally, the strap 90 may be worn over the user's shoulders such that the housing 84 is positioned near the user's waist.

A second processor 94 is positioned within the housing 84 and a second transceiver 96 is positioned within the housing 84. The second transceiver 96 is electrically coupled to the second processor 94 and the second transceiver 96 is electrical communication with the first transceiver 72. In this way the second processor 94 receives the physical location of the hammerhead mole 12.

A display 98 is coupled to the outer wall 88 of the housing 84 and the display 98 is visible to the user 92. The display 98 is electrically coupled to the second processor 94 and the display 98 displays indicia comprising the physical location of the hammerhead mole 12 and operational parameters of the hammerhead mole 12. The indicia may further include a depth of the hammerhead mole 12, an angle of attack of the hammerhead mole 12 and a route traveled by the hammerhead mole 12. The display 98 additionally displays the images captured by the camera 74 thereby facilitating the user 92 to view the route taken by the hammerhead mole 12. Additionally, the display 98 displays a visual alert when the plurality of metal detectors 78 detects metal thereby facilitating the user 92 to be alerted to the possibility of a water pipe, gas pipe or other metallic obstruction underground.

A plurality of buttons 100 is provided and each of the buttons 100 is movably coupled to the outer wall 88 of the housing 84. Each of the buttons 100 is electrically coupled to the second processor 94 to control operational parameters of the steering unit 26. The plurality of buttons 100 includes an up button 102, a down button 104, a left button 106 and a right button 108. The up button 102 turns on the motor 64 of the vertical actuator 60 to rotate in the first direction. In this way the head 50 urges the hammerhead mole 12 upwardly in the ground.

The down button 104 turns on the motor 64 of the vertical actuator 60 to rotate in the second direction. In this way the head 50 urges the hammerhead mole 12 downwardly in the ground. The left button 106 turns on the motor 64 of the horizontal actuator 62 to rotate in the third direction. Thus, the head 50 urges the hammerhead mole 12 to the left in the ground. The right button 108 turns on the motor 64 of the horizontal actuator 62 to rotate in the fourth direction. Thus, the head 50 urges the hammerhead mole 12 to the right in the ground.

The plurality of buttons 100 includes a forward button 109 and a reverse button 110. The forward button 109 turns the hammer 20 on in a forward direction to urge the hammerhead mole 12 forwardly in the ground. The reverse button 110 turns the hammer 20 on in a reverse direction to urge the hammerhead mole 12 rearwardly in the ground. A power supply 112 is positioned within the housing 84 and the power supply 112 is electrically coupled to the second processor 94. The power supply 112 comprises at least one battery 114.

In use, the hammerhead mole 12 is employed in the traditional convention of directional boring. This includes, but is not limited to, running cables beneath a roadway, driveway or any other immovable object that cannot be damaged during cable installation. The remote control 82 is manipulated to control the direction of the hammerhead mole 12 underground. Each of the buttons 100 on the housing 84 is selectively manipulated to urge the hammerhead mole 12 in the corresponding direction. In this way the hammerhead mole 12 is steered thereby enhancing accuracy of the hammerhead mole 12 with respect to traditional hammerhead moles 12.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A directional boring system comprising:

a hammerhead mole being fluidly coupled to a power source, said hammerhead mole being configured to bore underground in a selected direction, said hammerhead mole having a first end, an outer surface and a hammer, said first end having a well extending inwardly therein, said hammer extending into said well, said well having a bounding surface, said bounding surface being continuous such that said well forms a hemisphere;

a steering unit being movably coupled to said hammerhead mole wherein said steering unit is configured to frictionally engage the ground at a selected angle thereby facilitating said hammerhead mole to move in the selected angle; and a remote control being configured to be manipulated, said remote control being in wireless electrical communication with said steering unit such that said remote control controls movement of said hammerhead mole;

wherein said steering unit comprises a ball being rotatably positioned within said well, said ball having an aperture extending therethrough, said ball having an outer surface;

wherein said outer surface has a plurality of first depressions to define a plurality of first teeth, said first teeth being spaced apart from each other and being distributed around said ball, said first teeth being arranged to form a first row; and wherein said outer surface has a plurality of second depressions to define a plurality of second teeth, said second teeth being spaced apart from each other and being distributed around said ball, said second teeth being arranged to form a second row, said first row being spaced 90 degrees of rotation about said ball from said second row.

2. The system according to claim 1, further comprising a striking rod having a primary end and a second end, said striking rod extending through said aperture having said first end engaging said hammer and having said second end being spaced from a first end of said hammerhead mole.

3. The system according to claim 2, further comprising a head having a primary wall and a perimeter wall extending away therefrom, said perimeter wall being continuous around said primary wall, said perimeter wall tapering to a point from said primary wall wherein said head is configured to pierce the ground, said primary wall being coupled to said second end of said striking rod.

4. The system according to claim 1, further comprising a plurality actuators, each of said actuators being coupled to said hammerhead mole, each of said actuators being in mechanical communication with said ball, each of actuators selectively rotating said ball in a selected direction for steering, said plurality of actuators including a vertical actuator and a horizontal actuator.

5. The system according to claim 4, wherein each of said actuators comprises:

a motor being positioned within said hammerhead mole, said motor selectively rotating in a first direction and a second direction, said motor of said vertical actuator being aligned with said first row of teeth on said ball, said motor of said horizontal actuator being aligned with said second row of teeth;

a shaft being coupled to said motor such that said motor rotates said shaft when said motor is turned on; and a worm gear being coupled to said shaft such that said shaft rotates said worm gear when said motor is turned on.

6. The system according to claim 5, wherein said worm gear of said vertical actuator engages said first row of teeth, said worm gear of said vertical actuator urging said ball to rotate in a primary and secondary direction about a horizontal axis extending through said hammerhead mole wherein a head is configured to engage the ground at a selected vertical angle thereby facilitating said hammerhead mole to be selectively directed upwardly and downwardly in the ground.

7. The system according to claim 5, wherein said worm gear of said horizontal actuator engages said second row of teeth, said worm gear of said horizontal actuator urging said ball to rotate in a third and fourth direction about a vertical axis wherein a head is configured to engage the ground at a selected horizontal angle thereby facilitating said hammerhead mole to be selectively directed to the left and to the right in the ground.

8. The system according to claim 4, further comprising:

a first processor being positioned within said hammerhead mole, said first processor being electrically coupled to said vertical actuator, said horizontal actuator and to said power source; and a first transceiver being positioned within said hammerhead mole, said first transceiver being electrically coupled to said first processor, said first transceiver being configured to be in electrical communication with a global positioning system (gps) thereby facilitating said first processor to establish a physical location of said hammerhead mole.

9. The system according to claim 8, further comprising:

a head having a point;

a camera being coupled to said point on said head wherein said camera is configured to capture images of the ground in front of said head, said camera being electrically coupled to said first processor; and a plurality of first light emitters, each of said first light emitters being coupled to said outer surface of said hammerhead mole wherein each of said first light emitters is configured to emit light outwardly therefrom, each of said first light emitters being electrically coupled to said first processor.

10. The system according to claim 8, further comprising a head having a perimeter wall; and a plurality of metal detectors, each of said metal detectors being coupled to said outer surface of said hammerhead mole wherein each of said metal detectors is configured to detect metal in the ground, each of said metal detectors being electrically coupled to said first processor, a plurality of second light emitters, each of said second light emitters being coupled to said perimeter wall of said head wherein each of said second light emitters is configured to emit light outwardly therefrom, each of said second light emitters being electrically coupled to said first processor.

11. The system according to claim 1, wherein:

said steering unit includes a first transceiver; and said remote control comprises:

a housing having an outer wall;

a strap being coupled to said housing wherein said strap is configured to be worn by a user thereby facilitating said housing to be retained on the user;

a second processor being positioned within said housing;

a second transceiver being positioned within said housing, said second transceiver being electrically coupled to said second processor, said second transceiver being electrical communication with said first transceiver wherein said second processor is configured to receive the physical location of said hammerhead mole; and a display being coupled to said outer wall of said housing wherein said display is configured to be visible to the user, said display being electrically coupled to said second processor, said display displaying indicia comprising the physical location of said hammerhead mole and operational parameters of said hammerhead mole.

12. The system according to claim 11, further comprising a plurality of buttons, each of said buttons being movably coupled to said outer wall of said housing wherein each of said buttons is configured to be manipulated, each of said buttons being electrically coupled to said second processor to control operational parameters of said steering unit, said plurality of buttons including an up button, a down button a left button and a right button.

13. The system according to claim 12, wherein:

said hammerhead mole includes a hammer; and said plurality of buttons includes a forward button and a reverse button, said forward button turning said hammer on in a forward direction wherein said hammer is configured to urge said hammerhead mole forwardly in the ground, said reverse button turning said hammer on in a reverse direction wherein said hammer is configured to urge said hammerhead mole rearwardly in the ground.

14. A directional boring system comprising:

a hammerhead mole being fluidly coupled to a power source, said hammerhead mole being configured to bore underground in a selected direction;

a steering unit being movably coupled to said hammerhead mole wherein said steering unit is configured to frictionally engage the ground at a selected angle thereby facilitating said hammerhead mole to move in the selected angle; and a remote control being configured to be manipulated, said remote control being in wireless electrical communication with said steering unit such that said remote control controls movement of said hammerhead mole;

said steering unit includes a first transceiver;

said remote control comprising a housing having an outer wall, a strap being coupled to said housing wherein said strap is configured to be worn by a user thereby facilitating said housing to be retained on the user, a second processor being positioned within said housing, a second transceiver being positioned within said housing, said second transceiver being electrically coupled to said second processor, said second transceiver being electrical communication with said first transceiver wherein said second processor is configured to receive the physical location of said hammerhead mole, a display being coupled to said outer wall of said housing wherein said display is configured to be visible to the user, said display being electrically coupled to said second processor, said display displaying indicia comprising the physical location of said hammerhead mole and operational parameters of said hammerhead mole, and a plurality of buttons, each of said buttons being movably coupled to said outer wall of said housing wherein each of said buttons is configured to be manipulated, each of said buttons being electrically coupled to said second processor to control operational parameters of said steering unit, said plurality of buttons including an up button, a down button a left button and a right button;

wherein said steering unit includes a vertical actuator and a horizontal actuator, each of said vertical and horizontal actuators including a motor; and wherein said up button turns on said motor of said vertical actuator to rotate in a first direction wherein a head is configured to urge said hammerhead mole upwardly in the ground, said down button turning on said motor of said vertical actuator to rotate in a second direction wherein said head is configured to urge said hammerhead mole downwardly in the ground.

15. The system according to claim 14, wherein:

said left button turns on said motor of said horizontal actuator to rotate in a third direction wherein said head is configured to urge said hammerhead mole to the left in the ground; and said right button turning on said motor of said horizontal actuator to rotate in a fourth direction wherein said head is configured to urge said hammerhead mole to the right in the ground.

16. A directional boring system comprising:

a hammerhead mole being fluidly coupled to a power source, said hammerhead mole being configured to bore underground in a selected direction, said hammerhead mole having a first end, an outer surface and a hammer, said first end having a well extending inwardly therein, said hammer extending into said well, said well having a bounding surface, said bounding surface being continuous such that said well forms a hemisphere;

a steering unit being movably coupled to said hammerhead mole wherein said steering unit is configured to frictionally engage the ground at a selected angle thereby facilitating said hammerhead mole to move in the selected angle, said steering unit being in mechanical communication with said hammer, said steering unit comprising:

a ball being rotatably positioned within said well, said ball having an aperture extending therethrough, said ball having an outer surface, said outer surface having a plurality of first depressions to define a plurality of first teeth, said first teeth being spaced apart from each other and being distributed around said ball, said first teeth being arranged to form a first row, said outer surface having a plurality of second depressions to define a plurality of second teeth, said second teeth being spaced apart from each other and being distributed around said ball, said second teeth being arranged to form a second row, said first row being spaced 90 degrees of rotation about said ball from said second row, a striking rod having a primary end and a second end, said striking rod extending through said aperture having said first end engaging said hammer and having said second end being spaced from said first end of said hammerhead mole, a head having a primary wall and a perimeter wall extending away therefrom, said perimeter wall being continuous around said primary wall, said perimeter wall tapering to a point from said primary wall wherein said head is configured to pierce the ground, said primary wall being coupled to said second end of said striking rod, a plurality actuators, each of said actuators being coupled to said hammerhead mole, each of actuators being in mechanical communication with said ball, each of said actuators selectively rotating said ball in a selected direction for steering, said plurality of actuators including a vertical actuator and a horizontal actuator, each of said actuators comprising:

a motor being positioned within said hammerhead mole, said motor selectively rotating in a first direction and a second direction, said motor of said vertical actuator being aligned with said first row of teeth on said ball, said motor of said horizontal actuator being aligned with said second row of teeth, a shaft being coupled to said motor such that said motor rotates said shaft when said motor is turned on, a worm gear being coupled to said shaft such that said shaft rotates said worm gear when said motor is turned on, said worm gear of said vertical actuator engaging said first row of teeth, said worm gear of said vertical actuator urging said ball to rotate in a primary and secondary direction about a horizontal axis extending through said hammerhead mole wherein said head is configured to engage the ground at a selected vertical angle thereby facilitating said hammerhead mole to be selectively directed upwardly and downwardly in the ground, said worm gear of said horizontal actuator engaging said second row of teeth, said worm gear of said horizontal actuator urging said ball to rotate in a third and fourth direction about a vertical axis wherein said head is configured to engage the ground at a selected horizontal angle thereby facilitating said hammerhead mole to be selectively directed to the left and to the right in the ground, a first processor being positioned within said hammerhead mole, said first processor being electrically coupled to said vertical actuator, said horizontal actuator and to said power source, a first transceiver being positioned within said hammerhead mole, said first transceiver being electrically coupled to said first processor, said first transceiver being configured to be in electrical communication with a global positioning system (gps) thereby facilitating said first processor to establish a physical location of said hammerhead mole, a camera being coupled to said point on said head wherein said camera is configured to capture images of the ground in front of said head, said camera being electrically coupled to said first processor, a plurality of first light emitters, each of said first light emitters being coupled to said outer surface of said hammerhead mole wherein each of said first light emitters is configured to emit light outwardly therefrom, each of said first light emitters being electrically coupled to said first processor, a plurality of metal detectors, each of said metal detectors being coupled to said outer surface of said hammerhead mole wherein each of said metal detectors is configured to detect metal in the ground, each of said metal detectors being electrically coupled to said first processor, a plurality of second light emitters, each of said second light emitters being coupled to said perimeter wall of said head wherein each of said second light emitters is configured to emit light outwardly therefrom, each of said second light emitters being electrically coupled to said first processor; and a remote control being configured to be manipulated, said remote control being in wireless electrical communication with said steering unit such that said remote control controls movement of said hammerhead mole, said remote control comprising:

a housing having an outer wall, a strap being coupled to said housing wherein said strap is configured to be worn by a user thereby facilitating said housing to be retained on the user, a second processor being positioned within said housing, a second transceiver being positioned within said housing, said second transceiver being electrically coupled to said second processor, said second transceiver being electrical communication with said first transceiver wherein said second processor is configured to receive the physical location of said hammerhead mole, a display being coupled to said outer wall of said housing wherein said display is configured to be visible to the user, said display being electrically coupled to said second processor, said display displaying indicia comprising the physical location of said hammerhead mole and operational parameters of said hammerhead mole, a plurality of buttons, each of said buttons being movably coupled to said outer wall of said housing wherein each of said buttons is configured to be manipulated, each of said buttons being electrically coupled to said second processor to control operational parameters of said steering unit, said plurality of buttons including an up button, a down button a left button and a right button, said up button turning on said motor of said vertical actuator to rotate in said first direction wherein said head is configured to urge said hammerhead mole upwardly in the ground, said down button turning on said motor of said vertical actuator to rotate in said second direction wherein said head is configured to urge said hammerhead mole downwardly in the ground, said left button turning on said motor of said horizontal actuator to rotate in said third direction wherein said head is configured to urge said hammerhead mole to the left in the ground, said right button turning on said motor of said horizontal actuator to rotate in said fourth direction wherein said head is configured to urge said hammerhead mole to the right in the ground, said plurality of buttons including a forward button and a reverse button, said forward button turning said hammer on in a forward direction wherein said hammer is configured to urge said hammerhead mole forwardly in the ground, said reverse button turning said hammer on in a reverse direction wherein said hammer is configured to urge said hammerhead mole rearwardly in the ground, and a power supply being positioned within said housing, said power supply being electrically coupled to said second processor, said power supply comprising at least one battery.

* * * * *